US008966675B1

(12) United States Patent
Simeone

(10) Patent No.: US 8,966,675 B1
(45) Date of Patent: Mar. 3, 2015

(54) WATER CLOSET LIFTING DEVICE

(71) Applicant: Joseph A. Simeone, Woodbridge, CT (US)

(72) Inventor: Joseph A. Simeone, Woodbridge, CT (US)

( * ) Notice: Subject to any disclaimer, the term of this patent is extended or adjusted under 35 U.S.C. 154(b) by 0 days.

(21) Appl. No.: 14/178,755

(22) Filed: Feb. 12, 2014

(51) Int. Cl.
*E03D 11/00* (2006.01)
*E03D 11/13* (2006.01)

(52) U.S. Cl.
CPC ..... *E03D 11/13* (2013.01)
USPC ..... 4/252.1

(58) Field of Classification Search
CPC ..... E03D 11/16
USPC ..... 4/252.1–252.6
See application file for complete search history.

(56) References Cited

U.S. PATENT DOCUMENTS

| | | | | | |
|---|---|---|---|---|---|
| 4,052,759 | A * | 10/1977 | Hill | 4/252.4 |
| 4,554,689 | A * | 11/1985 | Segler | 4/254 |
| 4,648,139 | A * | 3/1987 | Stokes | 4/252.4 |
| 4,726,079 | A * | 2/1988 | Signori et al. | 4/420 |
| 4,777,671 | A * | 10/1988 | Kearns | 4/667 |
| 4,794,653 | A * | 1/1989 | Strasser | 4/252.1 |
| 4,886,302 | A * | 12/1989 | Forbes | 285/56 |
| 5,027,446 | A * | 7/1991 | Robertson | 4/254 |
| 5,031,251 | A * | 7/1991 | Williams et al. | 4/420 |
| 5,184,653 | A * | 2/1993 | Lacy | 141/98 |
| 5,303,430 | A * | 4/1994 | Fernie et al. | 4/254 |
| 5,377,361 | A * | 1/1995 | Piskula | 4/252.4 |
| 5,628,257 | A * | 5/1997 | Conner et al. | 108/158.12 |
| D383,835 | S * | 9/1997 | Gibbs | D23/311 |
| 6,094,752 | A * | 8/2000 | Loshaw | 4/252.1 |
| D453,956 | S * | 2/2002 | Elsner | D23/309 |
| 6,443,495 | B1 * | 9/2002 | Harmeling | 285/56 |
| 6,553,582 | B1 * | 4/2003 | Clark | 4/252.2 |
| 6,745,417 | B2 * | 6/2004 | Sumino | 4/662 |
| 6,751,812 | B2 * | 6/2004 | Malloy | 4/252.4 |
| 7,357,160 | B2 * | 4/2008 | Stanley | 141/98 |
| 7,426,756 | B2 * | 9/2008 | Clark | 4/420 |
| 8,069,502 | B2 * | 12/2011 | Coronado | 4/252.5 |
| 8,196,233 | B1 * | 6/2012 | Daniels | 4/420 |
| 8,313,130 | B2 * | 11/2012 | Hazel | 294/15 |
| 8,336,130 | B1 * | 12/2012 | Cardenas | 4/667 |
| 8,578,522 | B1 * | 11/2013 | Helmstetter et al. | 4/252.1 |
| 8,800,074 | B2 * | 8/2014 | Rodgers et al. | 4/667 |
| 2010/0229293 | A1 | 9/2010 | Rodgers et al. | |
| 2013/0216328 | A1 * | 8/2013 | Leibfried et al. | 411/326 |

FOREIGN PATENT DOCUMENTS

| | | |
|---|---|---|
| WO | 03016642 | 2/2003 |

* cited by examiner

*Primary Examiner* — Lori Baker

(57) ABSTRACT

A device for elevating the height of a toilet includes a plurality of bolt receiving sections configured for receiving the bolts or screws for securing the toilet and device to a soil pipe flange and floor, and includes an outlet section to align with the drain outlet of the toilet and the soil pipe and sealing member positioned in the floor. The base of the device may include a projection that serves as a wax ring retainer lip to accommodate an existing soil pipe flange and wax sealing material. The device can be mounted to a soil pipe flange in the same manner as the toilet would be mounted to the soil pipe flange, but allows the toilet height to be elevated from its standard height using the existing toilet and related equipment already in place.

18 Claims, 5 Drawing Sheets

WATER CLOSET LIFTING DEVICE

FIELD OF INVENTION

The present invention relates to a device to raise the seat height of a toilet (or water closet) to meet the needs of handicapped and other persons requiring additional seat height.

BACKGROUND OF THE INVENTION

Many manufacturers provide toilets of seat heights that differ from the standard or uniform height of a water closet or toilet seat (which is roughly 15 inches). These elevated seats accommodate those that may be handicapped or uncomfortable with a seat having the standard height. However, if a consumer needs to have a toilet having a higher seat height, they are required to buy an entirely new toilet having the preferred height and replace their existing toilet. These steps which include purchasing a new toilet, removing and disposing of the old toilet, and the plumbing labor costs, are substantial and often can be prohibitive to the consumer.

What is needed is an improved device and system that would allow consumers to elevate the height of their existing toilet without requiring the user to purchase a new water closet and at a minimum expense to the consumer.

SUMMARY OF THE INVENTION

The device of the present invention is a platform-like device that is configured so as to be secured to a soil pipe flange in the floor of a room and beneath the base of a toilet. The device thereby elevates the height of the toilet so that it can be easier to use for a handicapped individual, or any individual seeking an increased seat height.

The device includes a plurality of bolt receiving sections configured for receiving the bolts or screws for securing the toilet to the soil pipe flange and floor and includes a central, outlet opening section configured to align with the drain outlet of the toilet and the soil pipe and wax seal or sealing member positioned in the floor.

The base of the device is mounted onto an existing flooring and soil pipe flange. The base surface is substantially smooth and flat, and includes a projection that serves as a wax ring retainer lip to accommodate an existing soil pipe flange and wax sealing material. The base and base surface of the device may be configured in a manner similar to the base surface of the toilet with which the device is to be used.

The device can be mounted to the soil pipe flange and wax seal material in the floor in the same manner as the toilet would be mounted to the soil pipe flange and wax seal material. The mounting can be done with sealing wax and screws as would be done with the base of the toilet. The device includes multiple screws which are sufficient in length to accommodate the thickness of the device and the toilet floor rim. These screws may be the screws already in use to secure the toilet to the floor or may be an alternative set of screws.

The top surface of the device can be substantially smooth and flat and may comprise a wax retainer lip in the outlet opening configured to receive the base of the toilet, which would otherwise fit into the soil pipe flange. The top surface of the device thereby simulates the soil pipe flange and wax seal arrangement that the toilet would otherwise demonstrate. On the top surface of the device, a wax seal is placed and the screws projecting above the toilet floor rim are inserted through openings in the device to secure the device to the toilet and to the floor. This fastening securely anchors the toilet and device as a single unit to the soil pipe floor flange and the existing flooring.

The device according to the present invention can be made of materials including a rigid plastic, a plastic with surfaces simulating glazed china, or any other material that may be compatible and complimentary with the consumer or manufacturer's water closet, such as porcelain.

The perimeter joint between the device and the toilet base, or the perimeter joint between the device base and the floor, can be set dry. Alternatively, it can be set with a thin application of a sealing, caulking or grout to prevent any unevenness in the planting of the toilet on the device, or in the planting of the device on the floor.

According to a further embodiment of the invention, an elevated toilet system is provided. The elevated toilet system comprises a toilet having an outlet section, and a floor section comprising a plurality of bolt receiving sections. The system further includes an elevating device comprising a top surface, a base surface, a body section in between the top surface and the base surface, an outlet opening extending through the body section and aligned with the outlet section of the toilet, and a plurality of bolt receiving sections extending through the body section and aligned with the plurality of bolt receiving sections of the toilet. Positioned beneath and interacting with the elevating device, there is a sealing material comprising an opening aligned with the elevating device outlet opening and a soil pipe aligned with the outlet opening of the elevating device, and extending beneath a floor surface and comprising a soil pipe flange extending above the floor flange surface, and a plurality of bolt receiving sections. The device is mounted to the soil pipe flange in the existing flooring. A plurality of bolts secured to the soil pipe flange are inserted through the respective plurality of bolt receiving sections of the toilet, the elevating device and the soil pipe, and provided with a nut secured to each of the plurality bolts adjacent the floor section of the toilet, so that the arrangement of the toilet, the elevating device is secured together and the floor and flange.

DETAILED DESCRIPTION OF THE DRAWINGS

Figure 1:
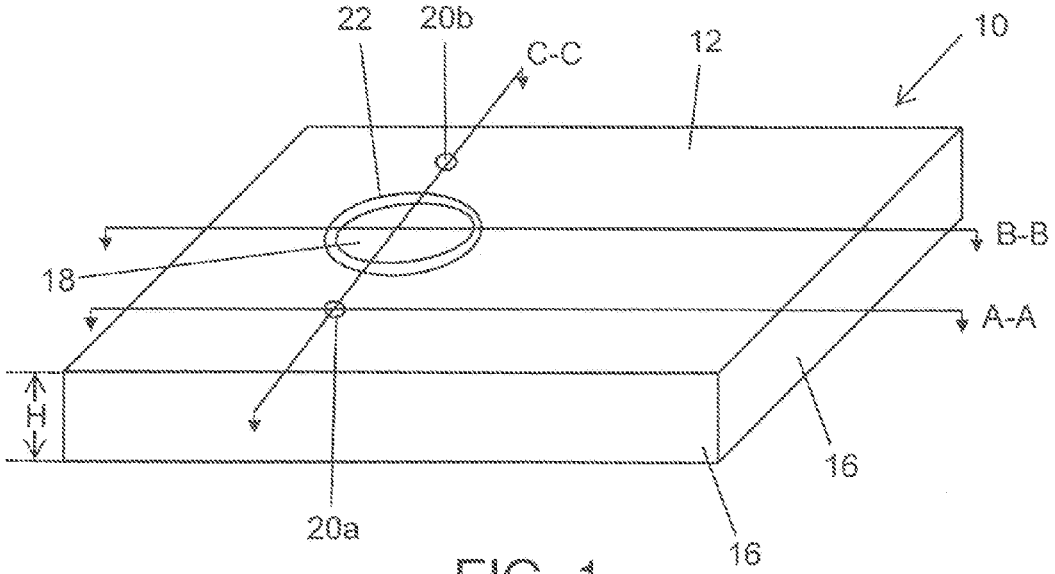
FIG. 1 shows a first, top-side view of an embodiment of the toilet elevating device according to the present invention.
Figure 2:
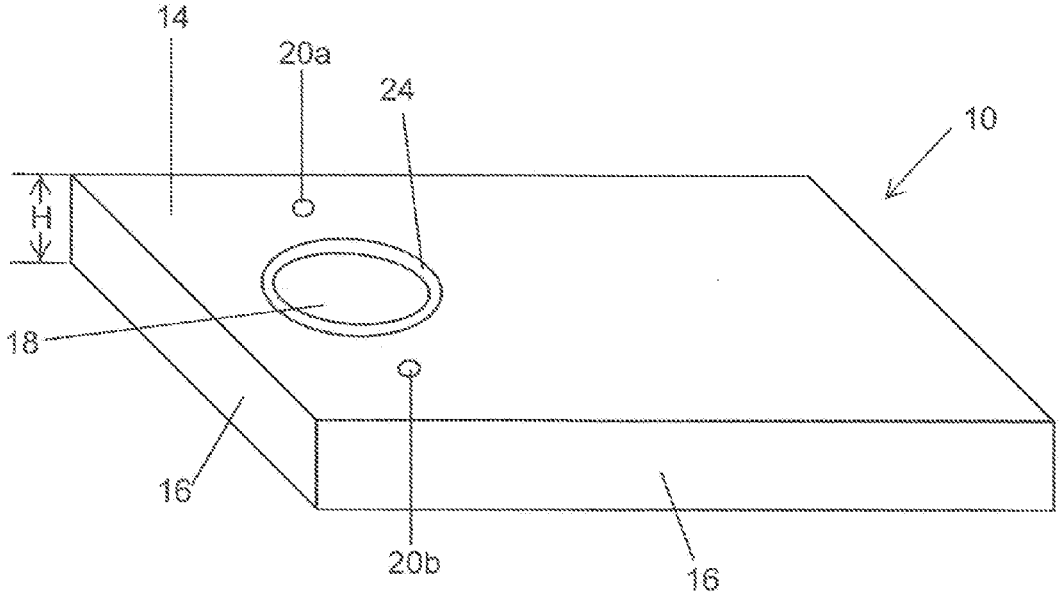
FIG. 2 shows a second, under-side view of an embodiment of the toilet elevating device according to the present invention.
Figure 3A:
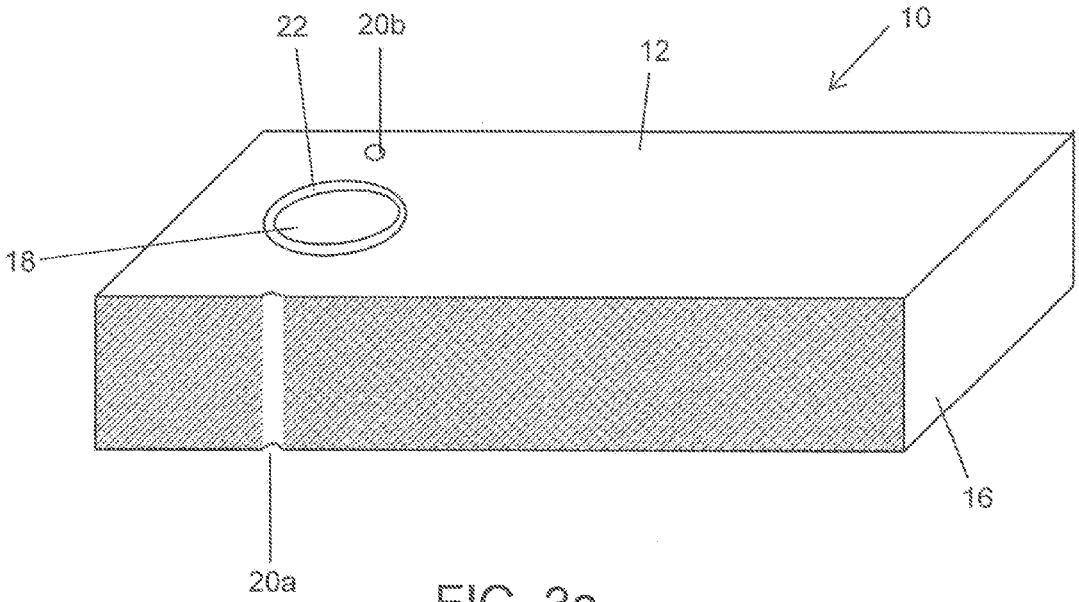
FIG. 3*a* shows a first cross-sectional view along axis A-A of an embodiment of the toilet elevating device according to the present invention.
Figure 3B:
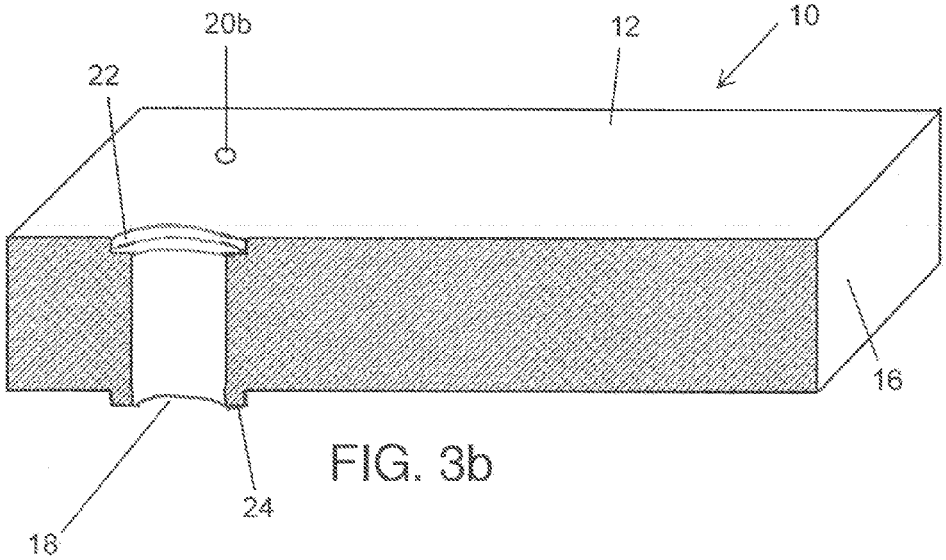
FIG. 3*b* shows a second cross-sectional along axis B-B view of an embodiment of the toilet elevating device according to the present invention.
Figure 4:
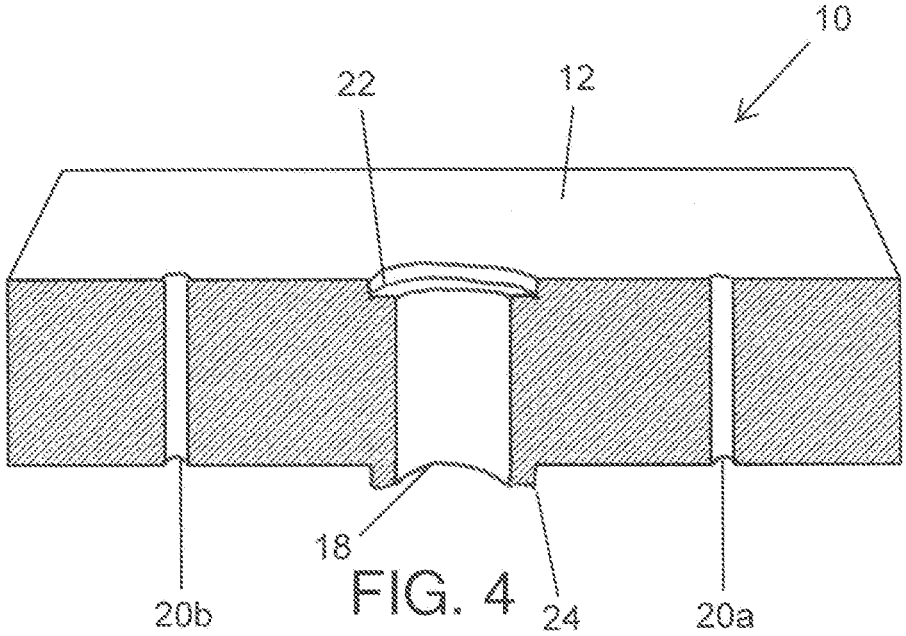
FIG. 4 shows a third cross-sectional along axis C-C view of an embodiment of the toilet elevating device according to the present invention.

The present invention, exemplary embodiments of which are shown in FIGS. 1-6, relates to a device 10 for elevating a toilet 200 or water closet to a raised height off of a floor 100. The device 10 allows a consumer to elevate the seat level for an existing toilet 200 owned by the consumer if the height of the seat of the toilet 200 is not sufficient.

The device 10, shown for example in FIGS. 1-4, includes a top surface 12, a bottom surface 14 and side surfaces 16. The device 10 has a height H. The device 10 may be manufactured or configured to have different, variable heights H, so that toilet 200 seat level can be elevated to the desired level depending on which device height H is used. If a consumer is using a device 10 having a first height H and it is later found to be insufficient for the consumer's needs, the consumer can replace it with a second device 10 having a second height H.

An outlet opening 18 extends through the body of the device 10 in between the top surface 12 and bottom surface 14. The opening 18 substantially corresponds in size to the outlet 208 of the toilet 200. The toilet 200 can be placed on top of the device 10 with the toilet outlet 208 aligned with the opening 18 so that fluid flows out of the outlet 208 of the toilet 200 through the opening 18 in the normal operation of the toilet 200.

The device 10 further includes a plurality of mounting holes 20*a* and 20*b* which serve as bolt receiving portions. The mounting holes 20*a* and 20*b* extend through the body of the device 10. The mounting holes 20*a* and 20*b* can be dimensioned to receive the bolts or screws, such as bolts 108*a* and 108*b*, that would be used to secure the toilet 200 to the floor 100 and soil pipe flange 104. The relative positions and dimensions of the opening 18 and mounting holes 20*a* and 20*b* can vary in different embodiments of the device 10 in order to accommodate the dimensions and orientation of the soil pipe 102, soil pipe flange 104, sealing member 106 and bolts 108*a* and 108*b*. In an exemplary embodiment, the sealing member 106 is a wax sealing member and the bolts 108*a* and 108*b* are brass screws, but the present invention is not limited to the use of these two materials for the sealing member 106 and bolts 108*a* and 108*b*, but can include any other material that is used in combination with the toilet 200 that is used in combination with the device 10.

In a preferred embodiment, the top surface 12 of the device 10 is configured with an indented lip 22 surrounding the opening 18. The lip 22 may be configured for aligning with a toilet floor ring 204 so as to improve the fit of the device 10 to the toilet 200. The lip 22 may also correspond in shape and size to a wax seal or other sealing material, such as sealing member 106. The indented lip 22 may also be configured with a sealing material, such as a wax retaining ring, such that the indented lip 22 is configured in a similar manner to the soil pipe flange 104 and sealing member 106. In this manner, indented lip 22 would allow the device 10 to interact with the base of the toilet 200 in the same manner as if the toilet 200 were placed on the floor 100.

In this preferred embodiment of the invention, the base surface 14 of the device 10 is configured with a protruding lip 24 extending from and surrounding the opening 18. The protruding lip 24 is dimensioned for engaging and aligning with a sealing member 106 and the flange 104 of a soil pipe 102. The lip 24 interacts with the sealing member 106 and flange 104 to improve the fit between the device 10 and the soil pipe 102 in the floor 100.

The device 10 can be made from a variety of materials in order to compliment the toilet 200 with which the device 10 will be used. In an exemplary embodiment, the device 10 is made of a rigid, plastic material and the top surface 12 and side surfaces 16 of the device 10 are polished to simulate a glazed china or porcelain to match the toilet 200. The device 10 is not limited to being made from plastic and can also be made from other suitable materials for matching with the toilet 200 and supporting the toilet 200, such as porcelain.

Although the device 10 as shown in the drawing is substantially rectangular in shape, the device 10 can be formed into any variety of shapes, such as square, ovular or circular.

Figure 5:
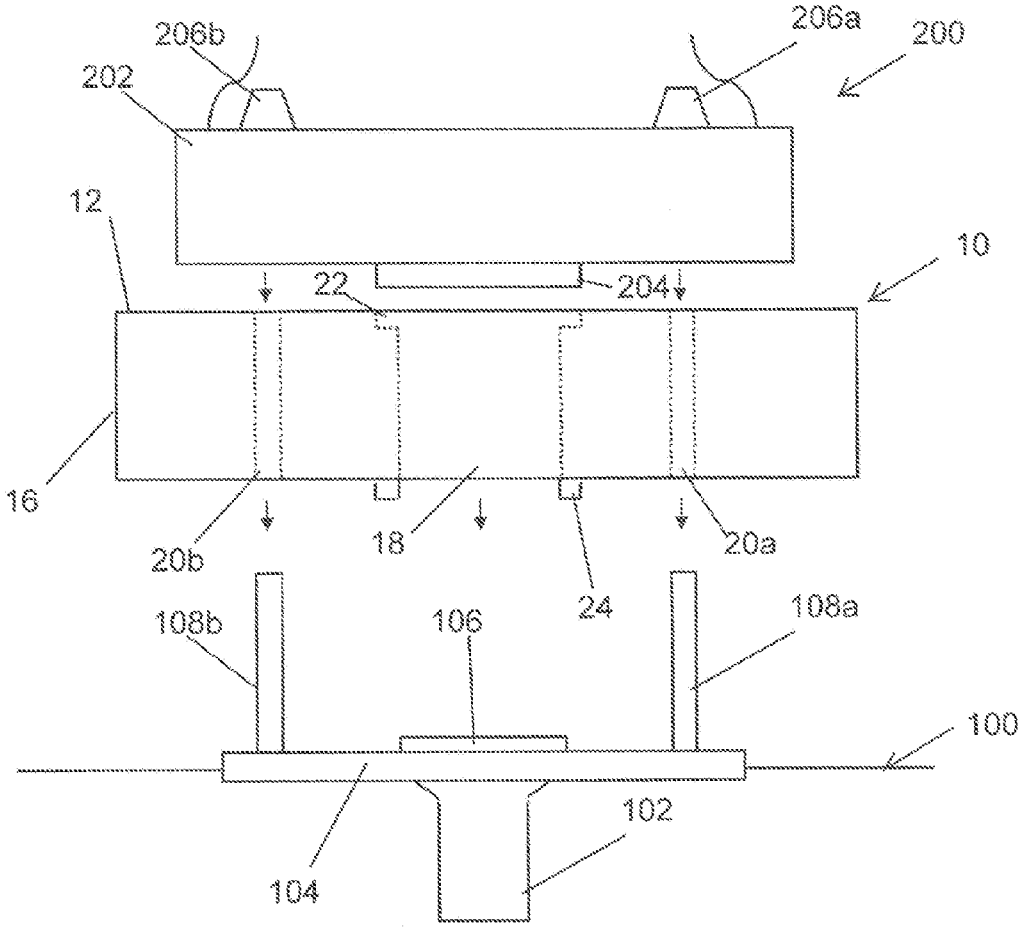
FIG. 5 shows an exploded view of an embodiment of the toilet elevating device according to the present invention in combination with an existing floor containing a soil pipe flange and seal.
Figure 6:
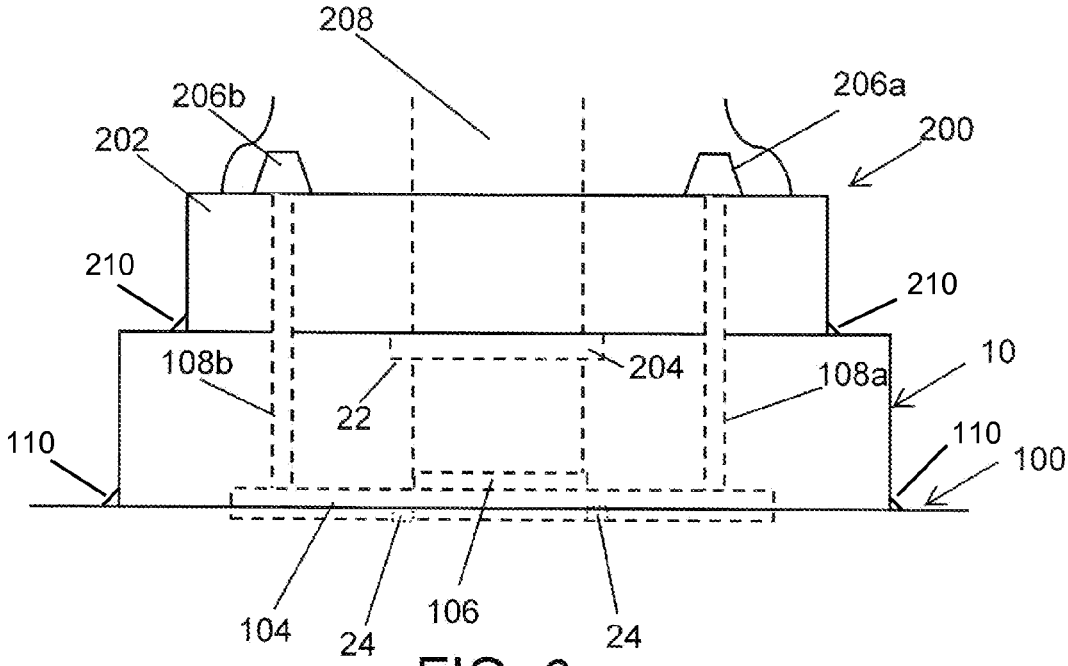
FIG. 6 shows an arrangement of an embodiment of the toilet elevating device according to the present invention in combination with a toilet and related components.

As shown in FIGS. 5 and 6, the device 10 is configured to elevate the height of the toilet 200 by lifting the toilet 200 off of floor 100 and inserting the device 10 between the floor 100 and toilet 200. In the process of elevating the height of toilet 200, the toilet 200 is disengaged from the soil pipe 102, soil pipe flange 104 and sealing member 106 by removing or unscrewing the screw tops or bolts 206*a* and 206*b* positioned on the toilet floor 202 from the bolts 108*a* and 108*b* extended from the flange 104 or floor 100. The toilet 200 can then be lifted off of the floor 100. With the toilet 200 removed, the device 10 can be inserted as shown in FIG. 5. The bolt receiving holes 20*a* and 20*b* (shown with dashed lines in FIGS. 5 and 6 to indicate that these components are located inside of the device 10, and not externally visible from the perspective shown in FIGS. 5 and 6) of the device 10 are aligned over the bolts 108*a* and 108*b*, which extend out of the soil pipe flange 104, and the outlet opening 18 is aligned with the soil pipe 102 and sealing member 106. The device 10 is then placed on top of the soil pipe 102 so that the bolts 108*a* and 108*b* extend through the bolt receiving holes 20*a* and 20*b* and the sealing member 106 and the soil pipe flange 104 are engaged in the lip 24 in the opening 18. This configuration of the device 10 relative to the soil pipe 102 and sealing member 106 is similar to the standard configuration that would be found between the toilet 200 and toilet floor 202 and the soil pipe 102 and sealing member 106 when the device 10 is absent. By using a similar configuration in its base surface 102 as would be found in the base of the toilet 200, it makes the use and installation of the device 10 easier for the consumer.

After the device 10 has been configured onto the floor 100 and over soil pipe 102, soil pipe flange 104 and sealing member 106, the toilet 200 can be arranged over the device 10. The outlet opening 208 and the bolt receiving portions (not shown) of the toilet 200 are respectively aligned over the opening 18 and the bolt receiving portions 20*a* and 20*b* of the device 10. The toilet 200 is lowered onto the device 10, so that the bolts 108*a* and 108*b* extend through the toilet floor 202 and through the bolt receiving portions of the toilet 200. The screw tops or nuts 206*a* and 206*b* can be secured to the top of the bolts 108*a* and 108*b* adjacent to the toilet floor 202 in order to secure together the toilet 200 and the device 10, and to secure each to the floor 100 to result in a single unit. When the toilet 200 is placed onto the device 10, the floor ring 204 of the toilet 200 is configured to engage the lip 22 extending into the top surface 12 the device 10. In this manner, the interaction and arrangement between the top surface 12 of the device 10 and the toilet 200 and toilet floor 202 is also similar to the arrangement that would be between the standard configuration that would be found between the toilet 200 and toilet floor 202 and the soil pipe 102/soil pipe flange 104 and sealing member 106 when the device 10 is absent.

At the intersection of the floor 100 and the device 10, and at the intersection of the device 10 and the toilet floor 202, a thin layer of sealant, caulk or grout 110 or 210 may be applied along the perimeter of the device 10 and/or toilet floor 204.

The device 10 according to the invention may further be configured with means for stacking more than one device. For example, the top surface 12 can comprise a series of protrusions for inserting into corresponding openings in the base surface 14 of a second device 10 to secure the two together, or the devices may be configured with a series of latching mechanisms to secure two devices 10 together. Further, the indented lip 22 and protruding lip 24 may be configured with a similar size and shape so as to be compatible with each other, so that the protruding lip 24 on the bottom surface 14 of a first device 10 may be inserted into the indented lip 22 on the top surface 12 of a second device 10 to secure the two devices together. The devices 10 may thus be stacked accordingly in order to further raise or adjust the height of the toilet 200.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed:

1. An elevated toilet system comprising:

a toilet comprising:

an outlet section, and a floor section comprising a plurality of bolt receiving sections;

a soil pipe aligned with the outlet opening of the toilet, and extending beneath a floor surface and comprising:

a soil pipe flange extending above the floor surface, and a plurality of bolt receiving sections;

a sealing material comprising an opening aligned with the outlet section of the toilet opening;

an elevating device comprising:

a top surface comprising a first lip having a shape and size corresponding to the soil pipe flange and sealing material, a base surface comprising a second lip having a shape and size configured to engage the soil pipe flange and sealing material, a body section in between the top surface and the base surface, an outlet opening extending through the body section and aligned with the outlet section of the toilet, and a plurality of bolt receiving sections extending through the body section and aligned with the plurality of bolt receiving sections of the toilet;

a plurality of bolts secured to the floor surface and inserted through the plurality of bolt receiving sections of the toilet, the elevating device and the soil pipe; and a nut secured to each of the plurality bolts, so that the arrangement of the toilet and the elevating device is secured to the soil pipe flange and floor.

2. The elevated toilet system according to claim 1, wherein the first lip the top surface of the elevating device is configured in the outlet opening and to fit within a corresponding floor ring positioned around the outlet section in a base of the toilet.

3. The elevated toilet system according to claim 2, wherein the first lip in the outlet opening on the top surface comprises a wax retaining ring.

4. The elevated toilet system according to claim 1, wherein the second lip of the elevating device further comprises a retainer ring protruding from the opening on the base surface of the elevating device and configured to accommodate the sealing material and the soil pipe flange.

5. The elevated toilet system according to claim 1, wherein the elevating device is made from a rigid, plastic material.

6. The elevated toilet system according to claim 5, wherein the elevating device is polished to simulate a glazed china or porcelain material.

7. The elevated toilet system according to claim 1, further comprising a layer of sealant applied around the perimeter of the bottom surface of the elevating device at a position where the elevating device meets the floor surface.

8. The elevated toilet system according to claim 1, further comprising a layer of sealant applied around the perimeter of the toilet floor section at a position where the elevating device meets the toilet floor section.

9. The elevated toilet system according to claim 1, wherein the sealing material is a wax seal.

10. The elevated toilet system according to claim 1, wherein the elevating device comprises a plurality of elevating devices stacked on top of one another.

11. A device for elevating the height of a toilet relative to a floor comprising:

a top surface comprising a first lip having a shape and size corresponding to a soil pipe flange and sealing material and sealing material positioned in the floor, a base surface comprising a second lip having a shape and size configured to engage the soil pipe flange and sealing material positioned in the floor, a body section in between the top surface and the base surface, an outlet opening extending through the body section configured to be aligned with an outlet section of the toilet, and a plurality of bolt receiving sections extending through the body section configured to be aligned with a plurality of bolt receiving sections of the toilet and to receive a plurality of bolts for securing the device to the toilet and the floor.

12. An elevated toilet system comprising:

a toilet comprising:

an outlet section, and a floor section comprising a plurality of bolt receiving sections;

a soil pipe aligned with the outlet opening of the toilet, and extending beneath a floor surface and comprising:

a soil pipe flange extending above the floor surface, and a plurality of bolt receiving sections;

a sealing material comprising an opening aligned with the outlet section of the toilet opening;

a plurality of stacked elevating devices, each elevating device comprising:

a top surface comprising a first lip having a shape and size corresponding to the soil pipe flange and sealing material, a base surface comprising a second lip having a shape and size configured to engage the soil pipe flange and sealing material, a body section in between the top surface and the base surface, an outlet opening extending through the body section and aligned with the outlet section of the toilet, and a plurality of bolt receiving sections extending through the body section and aligned with the plurality of bolt receiving sections of the toilet;

a plurality of bolts secured to the floor surface and inserted through the plurality of bolt receiving sections of the toilet, the elevating device and the soil pipe; and a nut secured to each of the plurality bolts, so that the arrangement of the toilet and the elevating device is secured to the soil pipe flange and floor.

13. The elevated toilet system according to claim 12, wherein the first lip the top surface of the elevating device is configured in the outlet opening and to fit within a corresponding floor ring positioned around the outlet section in a base of the toilet.

14. The elevated toilet system according to claim 13, wherein the first lip in the outlet opening on the top surface comprises a wax retaining ring.

15. The elevated toilet system according to claim 12, wherein the second lip of the elevating device further comprises a retainer ring protruding from the opening on the base surface of the elevating device and configured to accommodate the sealing material and the soil pipe flange.

16. The elevated toilet system according to claim 12, wherein the second lip on the base surface of the elevating device is configured to engage the first lip on the top surface of another elevating device stacked beneath the elevating device.

17. The elevated toilet system according to claim 12, wherein the plurality of elevating devices comprise latches to secure adjacent devices to each other.

18. The elevated toilet system according to claim 12, wherein the top surface of the plurality of elevating devices comprise one or more protrusions configured to engage corresponding one or more openings on the base of adjacently stacked elevating devices to secure two elevating devices together.

* * * * *